US008702452B2

(12) United States Patent
Tai et al.

(10) Patent No.: US 8,702,452 B2
(45) Date of Patent: Apr. 22, 2014

(54) ELECTRICAL CONNECTOR WITH IMPROVED SIGNAL TRANSMISSION QUALITY

(75) Inventors: Hung-Chi Tai, Jhonghe (TW); Yi-Chang Chen, Jhonghe (TW)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 35 days.

(21) Appl. No.: 13/610,444

(22) Filed: Sep. 11, 2012

(65) Prior Publication Data

US 2014/0004753 A1 Jan. 2, 2014

(30) Foreign Application Priority Data

Jul. 2, 2012 (CN) ..... 2012 1 0223762

(51) Int. Cl.
*H01R 24/76* (2011.01)

(52) U.S. Cl.
USPC ..... 439/660; 439/108

(58) Field of Classification Search
USPC ..... 439/660, 108
See application file for complete search history.

(56) References Cited

U.S. PATENT DOCUMENTS

| | | | | |
|---|---|---|---|---|
| 7,699,663 | B1 * | 4/2010 | Little et al. | 439/660 |
| 7,727,028 | B1 * | 6/2010 | Zhang et al. | 439/660 |
| 7,946,893 | B2 * | 5/2011 | Chen et al. | 439/660 |
| 8,152,569 | B2 * | 4/2012 | Chen et al. | 439/660 |
| 8,382,519 | B2 * | 2/2013 | Lin et al. | 439/607.01 |
| 2011/0269322 | A1 * | 11/2011 | He et al. | 439/78 |
| 2011/0281468 | A1 * | 11/2011 | Yu et al. | 439/660 |
| 2013/0196550 | A1 * | 8/2013 | Casher et al. | 439/660 |

* cited by examiner

*Primary Examiner* — Gary Paumen
(74) *Attorney, Agent, or Firm* — Sughrue Mion, PLLC

(57) ABSTRACT

A connector includes a housing, and contacts received in the housing. The contacts include first contacts and second contacts alternatively arranged with the first contacts. The first contacts include a ground contact and two pairs of differential pair. Each first contact includes a first contacting portion, a first termination portion extending beyond the housing and a first intermediate portion. The second contact includes a second contacting portion, a second termination portion extending beyond the housing and a second intermediate portion. The distance between the first intermediate portion of the differential pair of the first conductive contact and the second intermediate portion of and adjacent second conductive contact is bigger than or equal to the width of the first intermediate portion of the differential pair, and the width of the first intermediate portion is bigger than that of the second intermediate portion of the second conductive contact.

12 Claims, 7 Drawing Sheets

ELECTRICAL CONNECTOR WITH IMPROVED SIGNAL TRANSMISSION QUALITY

BACKGROUND OF THE INVENTION

1. Field of the Invention

The present invention relates to an electrical connector, more particularly to a USB connector complying with USB 3.0 protocol.

2. Description of Related Art

A conventional USB 3.0 is a common interface technology for high frequency signal transmission. Such USB 3.0 interface has a maximum of up to 4.8 Gpbs data transmission speed, where the USB 3.0 is also compatible to USB 2.0 version, however, in a lower speed. Nevertheless, in cases of conventional electrical connector of high frequency signal transmission, cross talk is prone to occur between adjacent conductive contacts, resulting in poorer the integrity of signal transmission. Along with the wider use of the high frequency signal as computer communication, how to reduce the cross talk of signal is becoming more and more important in design of electrical connectors.

Hence, it is necessary to improve the conventional electrical connector to address the problems mentioned above.

BRIEF SUMMARY OF THE INVENTION

Accordingly, an object of the present invention is to provide an electrical connector with improved high frequency signal transmission quality.

In order to achieve the aforementioned object, an electrical connector is provided, comprising an insulative housing, and a plurality of conductive contacts received in the insulative housing. The conductive contacts comprise a plurality of first conductive contacts and a plurality of second conductive contacts alternatively arranged with the first conductive contacts. The first conductive contacts comprise a ground contact and two pairs of differential pairs located at opposite sides of the ground contact. Each first conductive contact comprises a first contacting portion, a first termination portion extending beyond the insulative housing and a first intermediate portion connecting the first contacting portion and the first termination portion. The second conductive contact comprises a second contacting portion, a second termination portion extending beyond the insulative housing and a second intermediate portion connecting the second contact portion and the second termination portion. The distance between the first intermediate portion of the differential pairs of the first conductive contact and the second intermediate portion and the adjacent second conductive contact is bigger than or equal to the width of the first intermediate portion of the differential pair, and the width of the first intermediate portion is bigger than that of the second intermediate portion of the second conductive contact.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
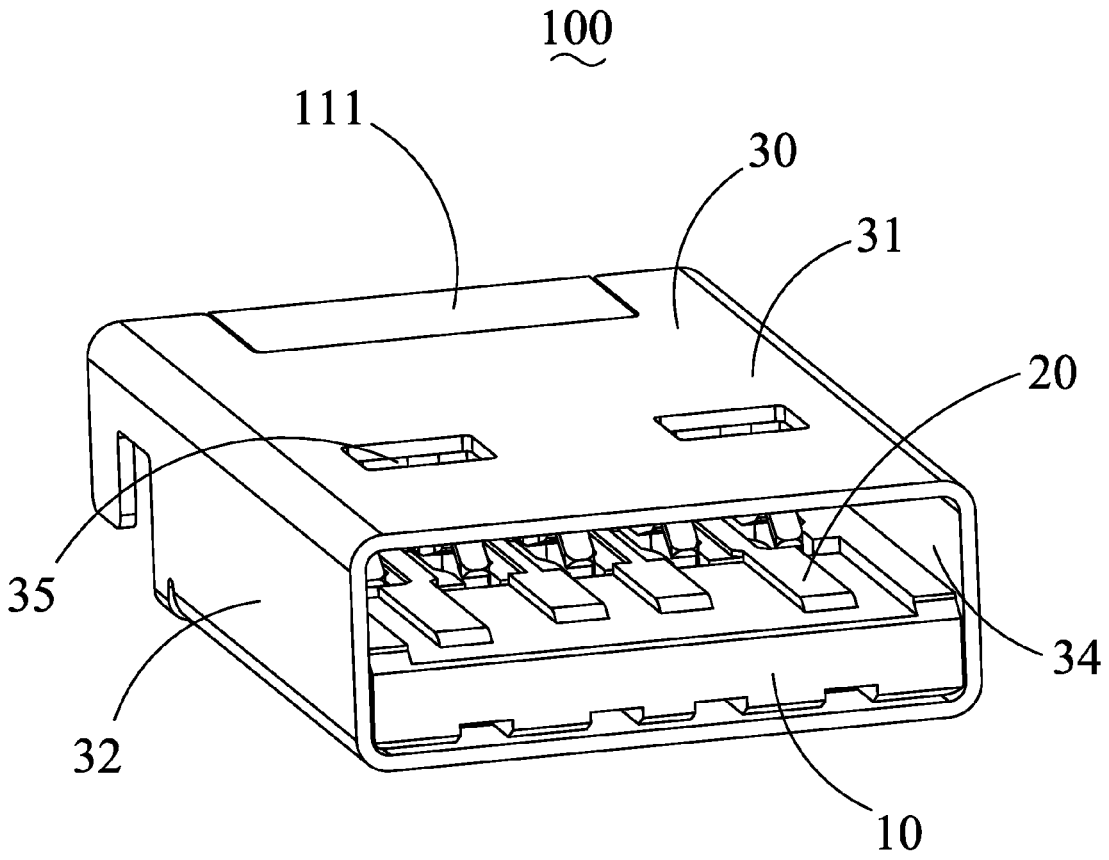
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
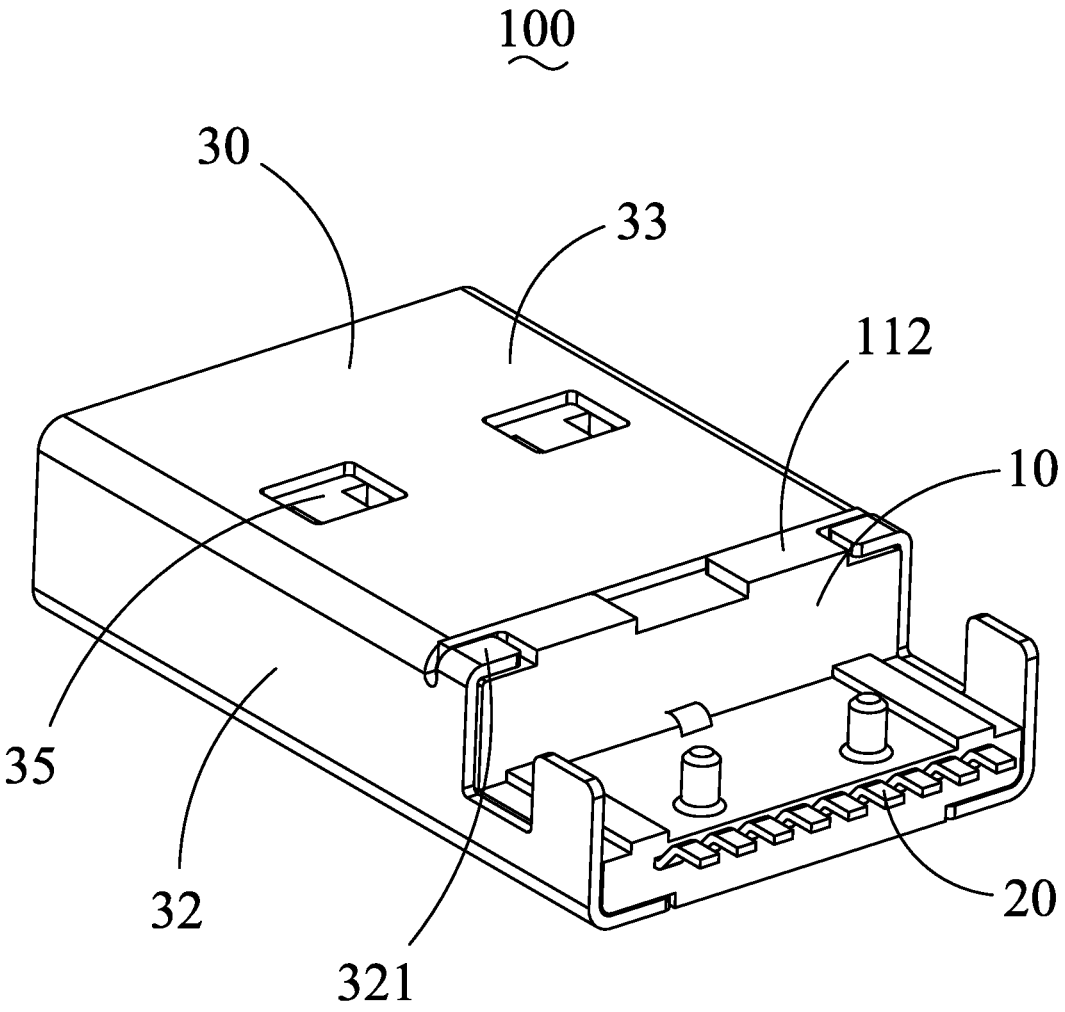
FIG. 2 is a view similar to FIG. 1, but from a different aspect.
Figure 3:
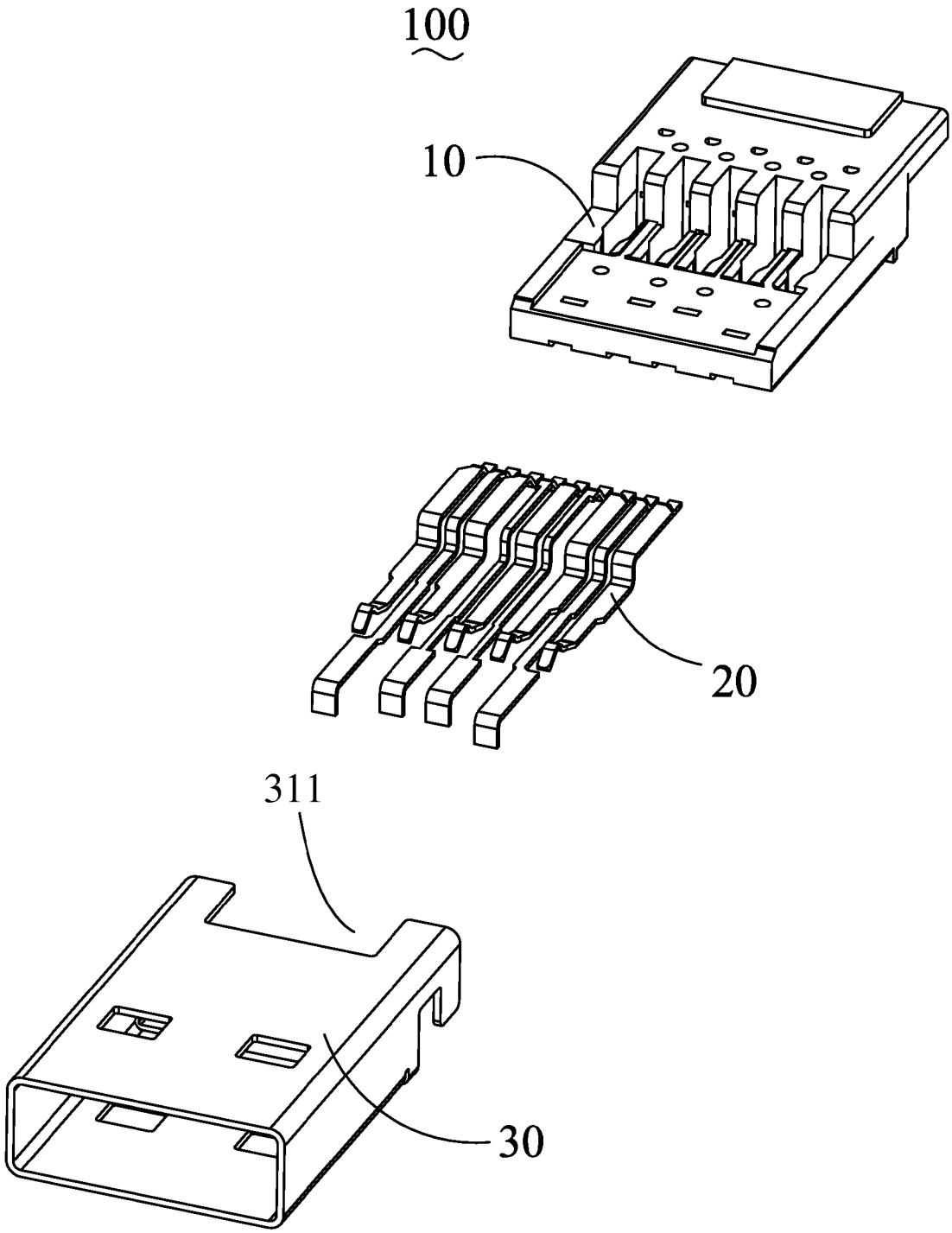
FIG. 3 is an exploded, perspective view of the electrical connector in accordance with the present invention.

Please refer to FIGS. 1-3, an electrical connector 100 in accordance with the present invention is capable of being mounted on an outer Printed Circuit Board (PCB, not shown). The electrical connector 100 comprises an insulative housing 10, a plurality of conductive contacts 20 accommodated in the insulative housing 10, and a metal shell 30 enclosing the insulative housing 10.

Figure 4:
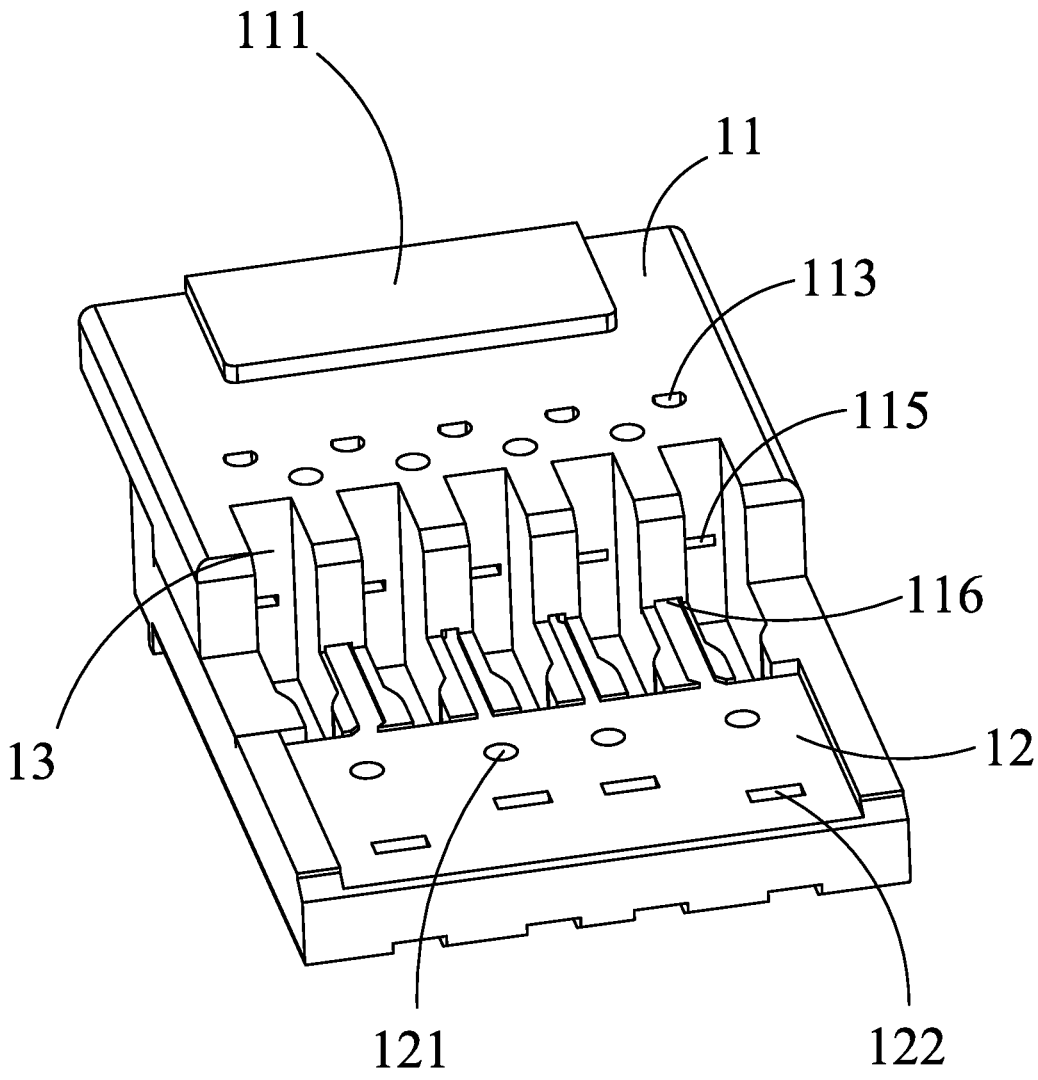
FIG. 4 is a perspective view of an insulative housing of the electrical connector.
Figure 5:
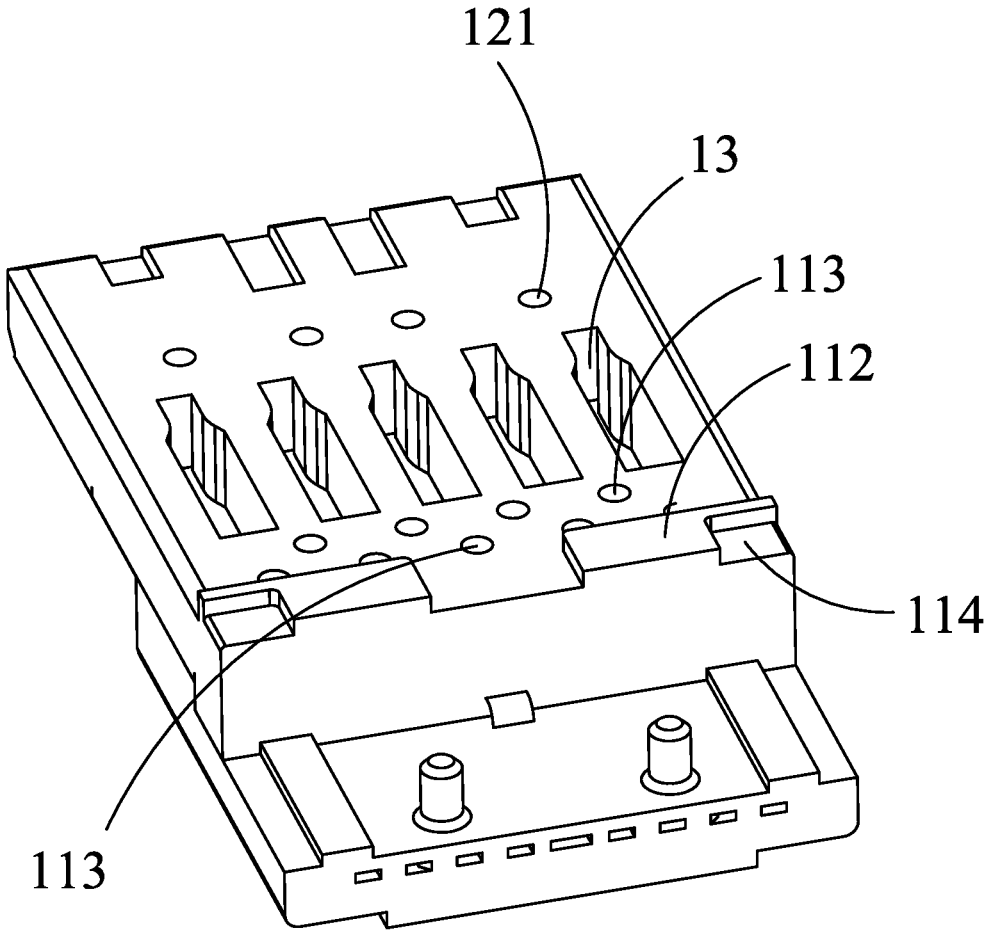
FIG. 5 is a view similar to FIG. 4, but from a different view.

Please refer to FIGS. 4-5, the insulative housing 10 comprises a main portion 11 and a mating portion 12 extending forwardly from the main portion 11. The main portion 11 forms a first restriction section 111 protruding upwardly from a top thereof, and a second restriction section 112 protruding downwardly from a bottom thereof. The second restriction section 112 defines a pair of recesses 114 at opposite lateral corners thereof. The first and second restriction sections 111, 112 are substantially rectangular. A plurality of first heat-radiation holes 113 are defined in the main portion 11 and adjacent to the mating portion 12 for enhancing the heat radiation effect. The first radiation holes 113 has round-shape cross-section. The main portion 11 also defines a plurality of first retaining slots 115 and a plurality of second retaining slots 116 alternatively arranged with the first retaining slots 115. Both the first and second retaining slots 115, 116 penetrate through the insulative housing 10 from a front section to a rear section of the insulative housing 10. The mating portion 12 is a flat board, and defines a plurality of second heat-radiation holes 121 adjacent to the main portion 11 and a plurality of tip receiving slots 122 penetrating therethrough. The tip receiving slots 122 correspond to the second retaining slots 116 respectively. A plurality of spaced openings 13 are defined at the junction section between the main portion 11 and the mating portion 12, which penetrate through the main portion 11 along up-to-down direction and communicate with the first retaining slots 115.

Figure 6:
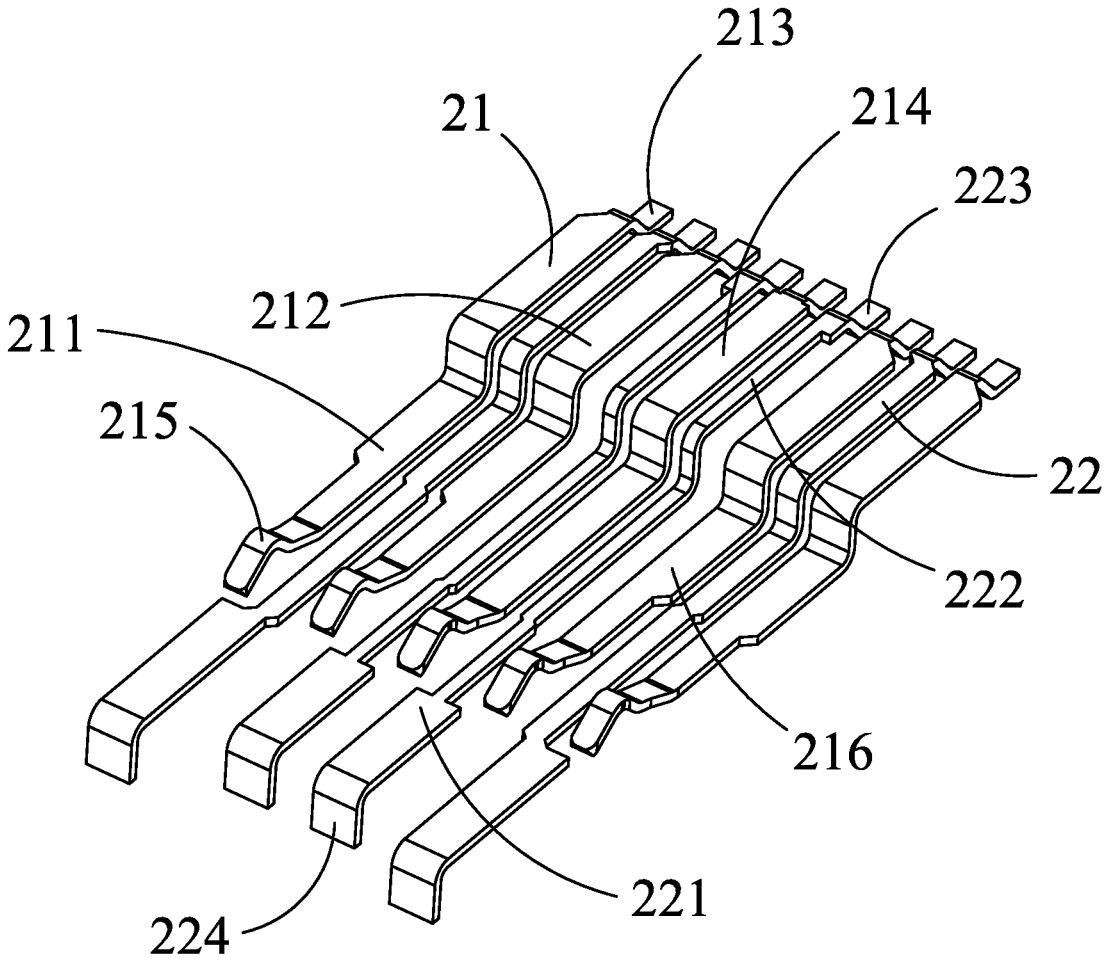
FIG. 6 is a perspective view of conductive contacts of the electrical connector in accordance with the present invention.
Figure 7:
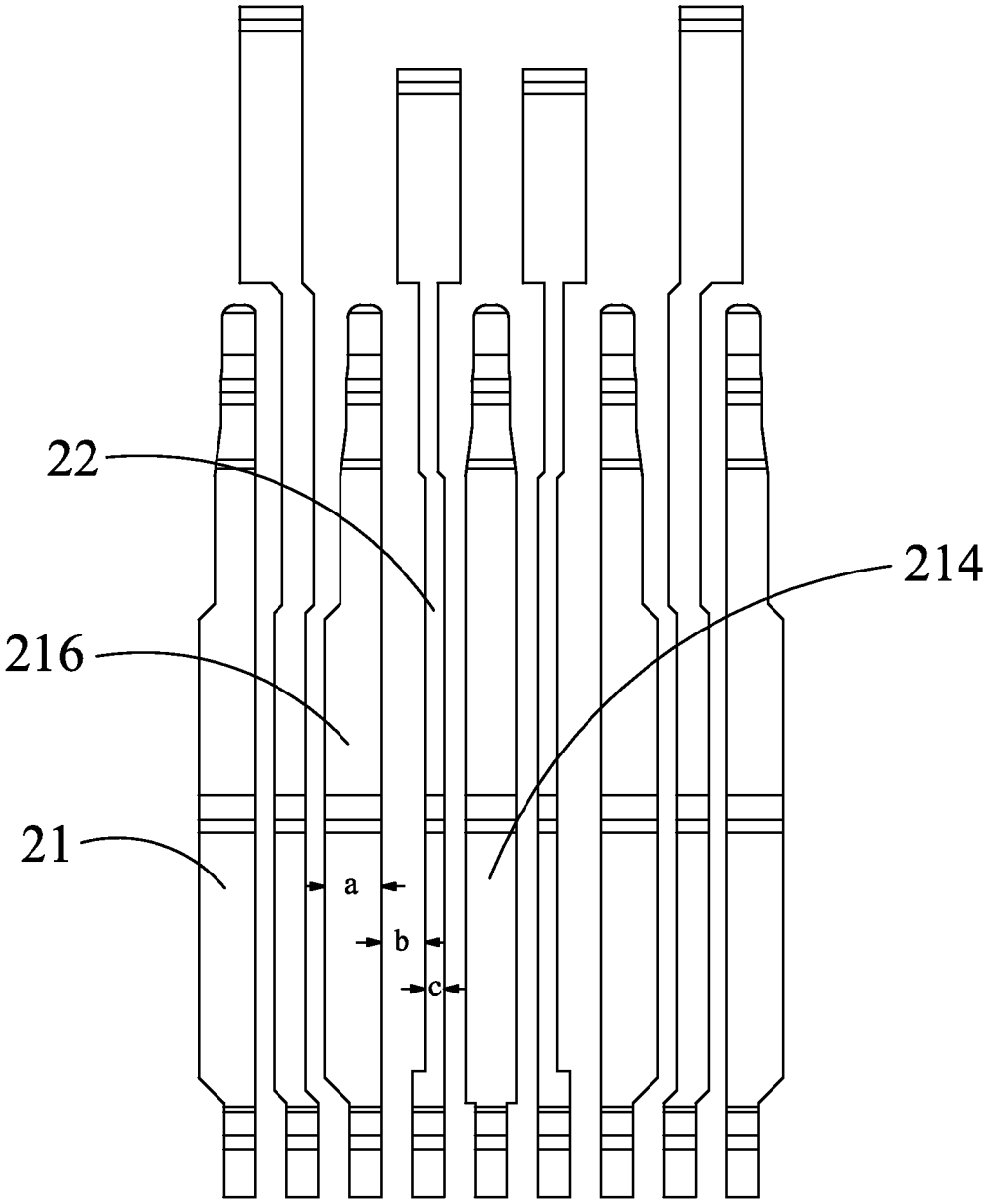
FIG. 7 is a view similar to FIG. 6, but from a different view.

Please refer to FIGS. 6-7, the conductive contacts 20 are grouped into first conductive contacts 21 and second conductive contacts 22 alternatively arranged with the first conductive contacts 21. The first conductive contacts 21 comprise a middle ground contact 214 and two pairs of differential pair 216 disposed at opposite sides of the ground contact 214. Each first conductive contact 21 comprises a first contacting portion 211 received in a corresponding spaced opening 13, a first termination portion 213 extending beyond the insulative housing 10, and a first intermediate portion 212 connecting the first contacting portion 211 and the first termination portion 213. The first contacting portion 211 is elastic and forms a curved contacting arm 215 at a free end thereof for electrically contacting with a complementary connector (not shown). The first intermediate portion 212 is received in a corresponding first retaining slot 115.

The second conductive contact 22 comprises a second contacting portion 221, a second termination portion 223 extending beyond the insulative housing 10, a second intermediate portion 222 connecting the second contacting portion 221 and the second termination portion 223, and a tip portion 224 bending vertically from the free end of the second contacting portion 221. The second contacting portion 221 is rigid and flat. The second intermediate portion 222 is received in a corresponding second retaining slot 116. The tip portion 224 is received in a corresponding tip receiving slot 122.

The first intermediate portions 212 of the first conductive contacts 21 and the second intermediate portions 222 of the second conductive contacts 22 are coplanar with one another, and the first termination portions 213 of the first conductive contacts 21 and the second terminations portions 223 of the second conductive contacts 22 are coplanar with one another. The distance between the first intermediate portion 212 of the differential pair 216 and the second intermediate portion 222 of an adjacent second conductive contact 22 is bigger than or equal to the width of the first intermediate portion 212 of the differential pair 216, and the width of the first intermediate portion 212 is bigger than that of the second intermediate portion 222 of the second conductive contact 22. Please refer to FIG. 7, if a stands for the width of the first intermediate portion 212, b stands for the distance between the first intermediate portion 212 of the differential pair 216 and the second intermediate portion 222 of the adjacent second conductive contact 22, and c stands for the width of the second intermediate portion 222 of the second conductive contact 22, then b is bigger than or equal to a, and a is bigger than c, hence effectively reducing the cross talk between the first and second conductive contacts 21, 22, and then improving the signal transmission quality of the electrical connector 100 in accordance with the present invention.

Please refer to FIGS. 1-2 and 5, the metal shell 30 encloses the insulative housing 10, and comprises an upper wall 31, a lower wall 33 opposite to the upper wall 31 and a pair of lateral walls 32 located between the upper and lower walls 31, 33. A receiving space 34 is circumscribed by the upper wall 31, the lower wall 33 and the pair of lateral walls 32 to receive the insulative housing 10. Each of the upper wall 31 and the lower wall 33 defines a pair of cooperating openings 35 for cooperating with the complementary connector for realizing stable electrical connection between the electrical connector 100 and the complementary connector. The upper wall 31 defines a cutout recessed forwardly from a rear edge thereof to cooperate with the first restriction section 111 for preventing excessive insertion of the insulative housing 10 in the metal shell 30. Each lateral wall 32 forms a latching arm 321 bent from a rear edge thereof adjacent to the lower wall 33 to cooperate with the recess 114 of the insulative housing 10 for preventing the insulative housing 10 escaping from the metal shell 30. Further, the lower wall 33 cooperates with the second restriction section 112 for preventing excessive insertion of the insulative housing 10 in the metal shell 30.

Compared with the prior arts, since the distance between the first intermediate portion 212 of the differential pair 216 and the second intermediate portion 222 of the second conductive contact 22 is bigger than or equal to the width of the first intermediate portion 212 of the differential pair 216, and the width of the first intermediate portion 212 is bigger than that of the second intermediate portion 222 of the second conductive contact 22, hence effectively reducing the cross talk between the first and second conductive contacts 21, 22, and then improving the signal transmission quality of the electrical connector 100 of the present invention effectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing;

a plurality of conductive contacts received in the insulative housing and comprising a plurality of first conductive contacts and a plurality of second conductive contacts alternatively arranged with the first conductive contacts; the first conductive contacts comprising a ground contact and two pairs of differential pair located at opposite sides of the ground contact, each first conductive contact comprising a first contacting portion, a first termination portion extending beyond the insulative housing and a first intermediate portion connecting the first contacting portion and the first termination portion;

each second conductive contact comprising a second contacting portion, a second termination portion extending beyond the insulative housing and a second intermediate portion connecting the second contacting portion and the second termination portion, wherein the distance between the first intermediate portion of the differential pairs of the first conductive contacts and the second intermediate portion of an adjacent second conductive contact is bigger than or equal to the width of the first intermediate portion of the differential pairs, and the width of the first intermediate portion is bigger than that of the second intermediate portion of the second conductive contact.

2. The electrical connector as claimed in claim 1, wherein the first intermediate portions of the first conductive contacts and the second intermediate portions of the second conductive contacts are coplanar with one another.

3. The electrical connector as claimed in claim 2, wherein the first termination portions of the first conductive contacts and the second termination portions of the second conductive contacts are coplanar with one another.

4. The electrical connector as claimed in claim 1, wherein the first contacting portion of the first conductive contact is elastic and forms a curved contacting arm at a free end thereof.

5. The electrical connector as claimed in claim 4, wherein the second contacting portion of the second conductive contact is rigid and flat and forms a tip portion bending vertically therefrom.

6. The electrical connector as claimed in claim 1, wherein the insulative housing comprises a main portion and a mating portion extending forwardly from the main portion.

7. The electrical connector as claimed in claim 6, wherein the main portion defines a plurality of first retaining slots to receive the first intermediate portions of the first conductive contacts, and a plurality of second retaining slots to receive the second intermediate portions of the second conductive contacts, and wherein the first and second retaining slots are alternatively arranged and penetrate through the insulative housing.

8. The electrical connector as claimed in claim 7, wherein the insulative housing defines a plurality of spaced openings at the junction section between the main portion and the mating portion to receive the first contacting portions of the first conductive contacts.

9. The electrical connector as claimed in claim 8, wherein the spaced openings penetrate through the insulative housing along an up-to-down direction and communicate with corresponding first retaining slots.

10. The electrical connector as claimed in claim 9, wherein the main portion and the mating portion respectively define a plurality of first heat-radiation holes and a plurality of second heat-radiation holes for enhancing heat radiation effect.

11. The electrical connector as claimed in claim 1, further comprising a metal shell enclosing the insulative housing.

12. The electrical connector as claimed in claim 11, wherein the metal shell comprises an upper wall, a lower wall opposite the upper wall and a pair of lateral walls located between the upper wall and the lower wall, and wherein a receiving space is circumscribed by the upper wall, the lower wall and the lateral walls to receive the insulative housing.

* * * * *